United States Patent [19]

Faltynek

[11] Patent Number: 5,009,518

[45] Date of Patent: Apr. 23, 1991

[54] WINDOW-STYLE BAG WITH INTEGRAL COUPON

[75] Inventor: Mark Faltynek, Chicago, Ill.

[73] Assignee: Bagcraft Corporation of America, Chicago, Ill.

[21] Appl. No.: 390,826

[22] Filed: Aug. 8, 1989

[51] Int. Cl.[5] ..... B65D 33/04

[52] U.S. Cl. ..... 383/106; 383/91; 383/111; 229/70; 206/45.31; 206/831

[58] Field of Search ..... 383/106, 127, 111, 91; 229/70, 162; 206/831, 45.31, 459; 40/312

[56] References Cited

U.S. PATENT DOCUMENTS

| | | | |
|---|---|---|---|
| Re. 24,962 | 4/1961 | Loderhose | 229/70 |
| 1,148,233 | 7/1915 | Jefferson | 229/70 |
| 1,752,504 | 4/1930 | Penrose | 206/45.31 |
| 3,155,273 | 11/1964 | Cote | 206/831 X |
| 3,183,614 | 5/1965 | Loderhose | 229/70 |
| 3,207,411 | 9/1965 | Farquhar | 206/45.31 |
| 3,300,039 | 1/1967 | Pilger | 206/45.31 |
| 3,315,877 | 4/1967 | Grevich | 383/91 |
| 3,545,669 | 12/1970 | Kinkade et al. | 229/70 X |
| 3,804,323 | 4/1974 | Bemel | 206/459 X |
| 4,509,197 | 4/1985 | Long | 383/106 |
| 4,762,271 | 8/1988 | Lewyt | 229/70 X |

FOREIGN PATENT DOCUMENTS

| | | | |
|---|---|---|---|
| 934095 | 10/1955 | Fed. Rep. of Germany | 206/459 |
| 2047860 | 4/1971 | Fed. Rep. of Germany | 206/831 |
| 6398 | of 1899 | United Kingdom | 383/106 |
| 709750 | 6/1954 | United Kingdom | 383/111 |

*Primary Examiner*—Stephen Marcus
*Assistant Examiner*—Jes F. Pascua

[57] ABSTRACT

There is disclosed herein a window-style bag which includes a removable coupon overlying and a transparent window-forming area where the consumer may view the contents of the bag. The coupon section overlies the transparent window-forming film and the bag aperture which forms the window. The coupon is intended for removal, and when so removed, the window viewing area is opened or enlarged, and the bag's structural integrity is substantially unaffected. In practice, the viewing section may be polygonal but is usually rectangular, but the coupon may be secured along two, three or four sides to the bag.

6 Claims, 1 Drawing Sheet

FIG. 1
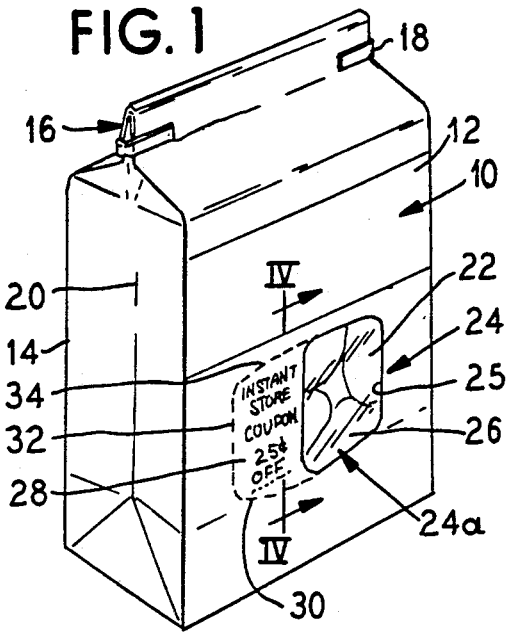
FIG. 2
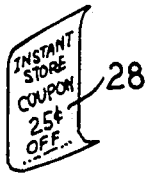
FIG. 3
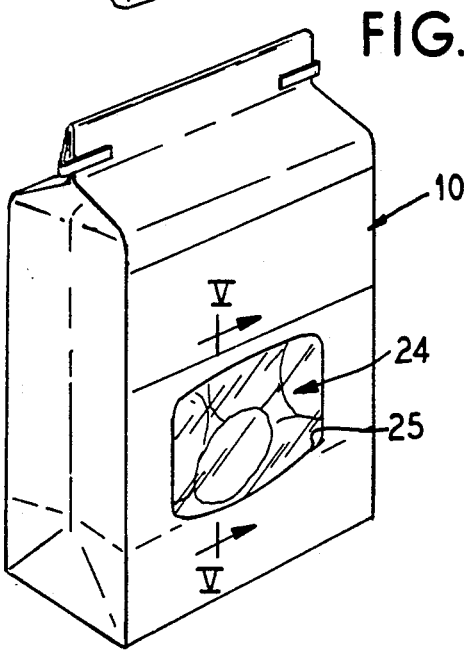
FIG. 4
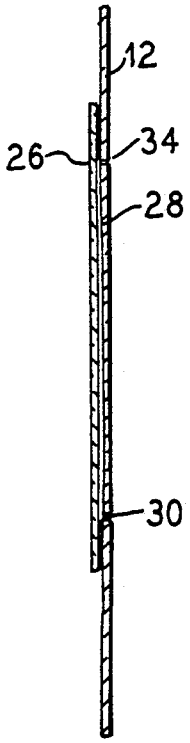
FIG. 5
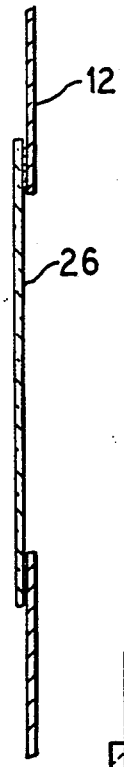
FIG. 6
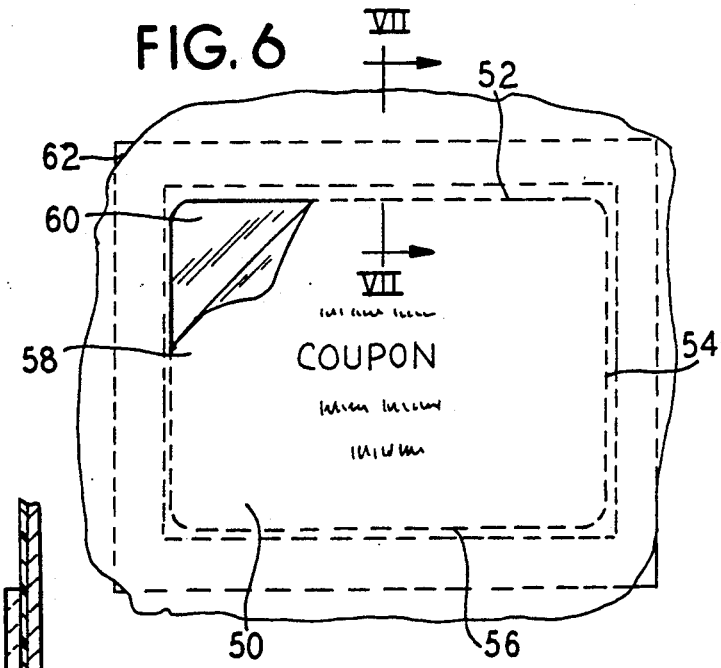
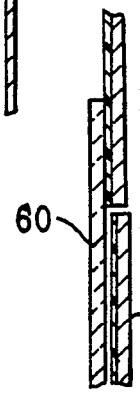
FIG. 7

WINDOW-STYLE BAG WITH INTEGRAL COUPON

BACKGROUND OF THE INVENTION

This invention relates to bags, and more particularly, to bags which have a window for viewing the contents thereof.

Paper bags having front, back, side, and bottom panels and a closable top for carrying goods are known. Some of these bags have a window in one panel, usually the front, which window is formed by cutting an aperture in the bag panel and then applying a sheet of transparent film to the inside of the bag and across the aperture. This provides a window through which the contents of the bags can be viewed. Sometimes contents are prepackaged in the bag, the bag top is closed, for example, by a bendable wire closure, and the bag and contents are placed on sale.

In order to enhance sales, it is sometimes desirable to provide a coupon in association with the bag. Such coupons may be separate members secured to the bag as by gluing or stapling. However, if the coupon is integral with the bag (i.e., printed on the bag) and is to be removed, the removal may degrade the structural integrity or carrying strength of the bag. Thus, separate coupons have been used which are not completely desirable because of costs, loss or removal.

It is therefore an object of this invention to provide a coupon system for a window bag which is integral with the bag, and whose removal will not significantly structurally degrade the bag.

It is another object to provide such a bag in which removal of the coupon enhances viewing the contents.

It is yet another object to provide such a bag which minimizes the costs, loss and/or removal of the couponing system.

It is a further object of this invention to provide a method for making such a bag and couponing system.

These and other objects of this invention will become apparent from the following disclosure and appended claims.

SUMMARY OF THE INVENTION

There is disclosed herein a window-type bag with a couponing system which meets the foregoing objects. In this system, a coupon is formed integral with the bag but removably secured to the bag at the window-forming aperture by perforations. The coupon can be constructed to overlie a part of the film so that the window is partly exposed. Thus the consumer can view the contents and also see the coupon. In some situations the coupon may completely overlie the film, and thus close the window so that no window is available until the coupon is removed. The coupon is removed from the bag by tearing it along perforation lines at the window-forming aperture. When this is done, the viewing window area is exposed or enlarged and the bag's structural integrity is substantially unaffected. In practice, the coupon may be secured to the bag along perforation lines along two, three or four sides of the aperture.

BRIEF DESCRIPTION OF THE DRAWINGS

FIG. 1 is a perspective view of a closed bag having a window and coupon partially covering the window;

FIG. 2 is a perspective view of a coupon of the type in FIG. 1 removed from the bag;

FIG. 3 is a perspective view of a bag as in FIG. 1 but with the coupon removed;

FIG. 4 is a sectional view taken along line IV—IV of FIG. 1 showing the coupon and window formation for the bag;

FIG. 5 is a sectional view taken along line V—V of FIG. 3 showing a bag and window construction with the coupon removed;

FIG. 6 is an elevational view of a fragment of the front panel of a bag showing the coupon secured along four sides and completely closing the window, but bent back for removal; and FIG. 7 is a view taken along line VII—VII of FIG. 6 showing the manner of connection of the coupon to the bag.

DESCRIPTION OF THE PREFERRED EMBODIMENT

Referring now to FIG. 1, there is shown a bag 10 generally which includes a front panel 12, a back panel similar to the front panel but not shown herein, a pair of side panels, one of which is shown, such as 14, and a bottom panel (not shown herein). The bag has a closable top portion 16 which is shown folded closed and held closed by a bendable wire closure member 18. This is a typical paper bag and can be folded flat along the fold lines such as 20. This type of bag can carry contents, such as 22, and has a viewing window or area such as 24. A window is formed by cutting an aperture 25 in the front panel and then covering that aperture or hole from the inside with a transparent film, such as 26.

The film is substantially larger than the aperture 25. In this embodiment the aperture 25 is formed by fully cutting through the panel where viewing is to take place and perforating the remainder of the panel so that a coupon section 28 generally is formed adjacent the initial viewing area **24*a*. The coupon section is formed in this situation by three perforations 30, 32 and 34, which define the coupon section relative to the bag panel 12. The coupon section 28 is perforated at the same time the aperture 25 and initial viewing area 24*a* is formed. Thus when the window-forming film 26 is applied, it is applied over both the cut viewing section 27 and the perforated coupon-forming section 28. When the coupon section 28 is removed by tearing along the perforations 30, 32 and 34, the window-forming film 26 is left intact and is behind the section of coupon which has been removed. In effect, the viewing area 24 has been made larger by the size of the coupon 28** that has been removed. In addition, the coupon configuration may be cross-shaped, etc. Removal of the coupon section therefrom does not detract from the integrity of the bag for carrying goods since the bag's carrying ability depends upon the transparent section to provide the strength in the area where the coupon has been removed.

Referring now to FIGS. 2 and 3, it is seen that the coupon section 28 has been removed from the window area for use but removal has just enlarged the viewing area 24 so that the bag still remains closed, is structurally integral and the viewing area 24 has been increased in size by the removal of the coupon section 28.

The window shown herein is generally rectangular and may be referred to as a round cornered square. However, numerous different polygonal configurations can be used and related coupons. Such coupons can be secured along two or four sides to the bag and still provide the desired integral nature and enlarged viewing area.

Referring now to FIG. 6, a full-size coupon 50 is shown which is connected to the aperture along all four sides 52, 54, 56 and 58. The coupon 50 is so shaped so as to totally overlie the window such as 60. The window-forming film, such as 62, is secured to the inside of the bag so as to form the transparent window. Removal of the coupon is performed by tearing the coupon from the bag panel along the perforations. Initially, the purchaser only sees a bag with a coupon, but as the coupon is separated from the bag, the viewing area is intact, the contents can be seen, and the structural integrity of the bag is maintained.

It will be appreciated that numerous other embodiments of the coupon and window can be provided so long as the coupon is secured to the panel in such a way to avoid degradation of the bag's structural integrity and permit viewing of the bag's contents.

Although the invention has been described with respect to preferred embodiments, it is not to be so limited as changes and modifications can be made which are within the full intended scope of the invention as defined by the appended claims.

I claim

1. An open-topped bag for carrying goods on the inside thereof, which comprises bottom, side, back and front walls, said front wall having a window defined by an aperture area and a transparent film secured to said front wall on the inside thereof and overlying said aperture area:

wherein the improvement comprises said front wall including a coupon defining section having a perimeter and separably connected to but integral with said front wall in said aperture area, said section being connected to the front wall along less than the section's entire perimeter and constructed to overlie at least a portion of said transparent film;

whereby said coupon section can be removed from the bag without adversely affecting the integrity of the bag and exposing previously unexposed transparent film so as to provide for greater viewing of the contents after separation than before separation of the coupon section from the bag.

2. A bag as in claim 1, wherein there is provided a bendable wire closure member adjacent the top end of one of the front or back panels for closing the bag.

3. An open-topped bag for carrying goods on the inside thereof, which comprises bottom, side, back and front walls, said front wall having a window defined by an aperture area and a transparent film secured to said front wall on the inside thereof and overlying said aperture area:

wherein the improvement comprises said front wall including a coupon defining section separably connected to but integral with said front wall in said aperture area and constructed to overlie at least a portion of said transparent film;

whereby said coupon can be removed from the bag without adversely affecting the integrity of the bag and exposing previously unexposed transparent film so as to provide for greater viewing of the contents after separation than before separation of the coupon section from the bag; and wherein said coupon section is connected to the bag along three sides and the coupon section overlies only a portion of the transparent film so as to form an initial viewing area adjacent to said coupon section.

4. A bag as in claim 3, wherein there is provided a bendable wire closure member adjacent the top end of one of the front or back panels for closing the bag.

5. An open-topped bag for carrying goods on the inside thereof, which comprises bottom, side, back and front walls, said front wall having a window defined by an aperture area and a transparent film secured to said front wall on the inside thereof and overlying said aperture area:

wherein the improvement comprises said front wall including a coupon defining section separably connected to but integral with said front wall in said aperture area and constructed to overlie at least a portion of said transparent film;

whereby said coupon can be removed from the bag without adversely affecting the integrity of the bag and exposing previously unexposed transparent film so as to provide for greater viewing of the contents after separation than before separation of the coupon section from the bag;

wherein said coupon section is connected to the bag along three sides and the coupon section overlies only a portion of the transparent film so as to form an initial viewing area adjacent to said coupon section; and wherein said aperture has a substantially rectangular shape and after removal of the coupon section the aperture has a larger substantially rectangular shape.

6. An open-topped bag for carrying goods on the inside thereof, which comprises bottom, side, back and front walls, said front wall having a window defined by an aperture area and a transparent film secured to said front wall on the inside thereof and overlying said aperture area:

wherein the improvement comprises said front wall including a coupon defining section separably connected to but integral with said front wall in said aperture area and constructed to overlie at least a portion of said transparent film and thus form an initial viewing area adjacent the coupon section;

whereby said coupon section can be removed from the bag without adversely affecting the integrity of the bag and exposing previously unexposed transparent film so as to provide for greater viewing of the contents after separation than before separation of the coupon section from the bag;

wherein said viewing aperture is polygonally shaped.

* * * * *